United States Patent [19]

Fukuoka et al.

[11] 4,355,529

[45] Oct. 26, 1982

[54] APPARATUS FOR MANUFACTURING A CYLINDRICAL MEMBER

[75] Inventors: Tatsuhiko Fukuoka; Shigeo Ichikawa; Satoru Nomichi, all of Toyota, Japan

[73] Assignee: Taiho Kogyo Co., Ltd., Toyota, Japan

[21] Appl. No.: 84,034

[22] Filed: Oct. 11, 1979

[30] Foreign Application Priority Data

Oct. 16, 1978 [JP] Japan ..... 53/127017

[51] Int. Cl.[3] ..... B21D 37/10

[52] U.S. Cl. ..... 73/412; 72/404

[58] Field of Search ..... 72/412, 414, 415, 416, 72/470, 474, 475, 368, 404; 29/517, 237

[56] References Cited

U.S. PATENT DOCUMENTS

| | | | |
|---|---|---|---|
| 977,118 | 11/1910 | Minshull | 72/379 |
| 1,330,782 | 2/1920 | Brown | 72/404 |
| 1,831,033 | 11/1931 | Richter | 72/404 |
| 1,964,584 | 6/1934 | Klocke | 72/404 |
| 2,480,378 | 8/1949 | Myers | 72/465 |
| 3,769,678 | 11/1973 | Marsden | 29/517 |

FOREIGN PATENT DOCUMENTS

| | | | |
|---|---|---|---|
| 366807 | 3/1963 | Switzerland | 72/416 |

*Primary Examiner*—Gene Crosby

*Attorney, Agent, or Firm*—Blanchard, Flynn, Thiel, Boutell & Tanis

[57] ABSTRACT

An apparatus is provided for manufacturing a cylindrical member utilizing a pair of dies each of which has a semi-cylindrical recess formed therein and which are adapted to be brought into abutment against each other to form a material disposed within the recesses into a cylindrical form. The abutting surfaces of the pair of dies are offset from a plane which includes the axis of a cylindrical member to be formed within the recesses of the dies and which is perpendicular to the direction of movement of one or both of the dies. In this manner, the formation of a bulge or flash on the outer periphery of the cylindrical member can be prevented which may be formed if the abutting surfaces lie in said plane.

5 Claims, 4 Drawing Figures

APPARATUS FOR MANUFACTURING A CYLINDRICAL MEMBER

BACKGROUND OF THE INVENTION

The invention relates to an apparatus for manufacturing a cylindrical member such as a spacer, bush, a sliding bearing or the like, and more particularly, to such apparatus which is used in particular toward the end of the manufacturing process of such cylindrical members.

A conventional technique for fabrication of a cylindrical member comprises bending a strip material, cut to length, into a U- or elliptical configuration. Such strip is then placed in semi-cylindrical recesses formed in a pair of dies, which are then brought into abutting engagement with each other to form the strip into a cylindrical member. In this arrangement, the recesses are formed to present semi-circular profiles which are equal to each other, and the abutting surfaces of both dies are placed in a plane which includes the axis of the cylindrical member to be formed and which is perpendicular to the direction of the movement of the dies. This results in a bulge or flash of the strip material being formed into the space between the abutting surfaces of the dies as will be further described later. Such bulge must be removed as by grinding or polishing the peripheral surface of the resulting cylindrical member when a high degree of true circularity is required of the cylindrical member.

SUMMARY OF THE INVENTION

It is an object of the invention to provide an apparatus for manufacturing a cylindrical member in a manner such that the latter may be formed without the formation of an unnecessary bulge. This object is accomplished in accordance with the invention by placing a pair of dies in a manner such that their abutting surfaces are offset from a plane which includes the axis of the cylindrical member to be formed within the recesses of the dies and which is perpendicular to the direction of movement of the dies.

It is another object of the invention to enable the use of a pair of dies of an identical configuration even though their abutting surfaces are offset from the described plane, thus facilitating the preparation of the dies.

Other objects and advantages of the invention will become apparent from the following description when taken together with the attached drawings.

DETAILED DESCRIPTION

Figure 1:
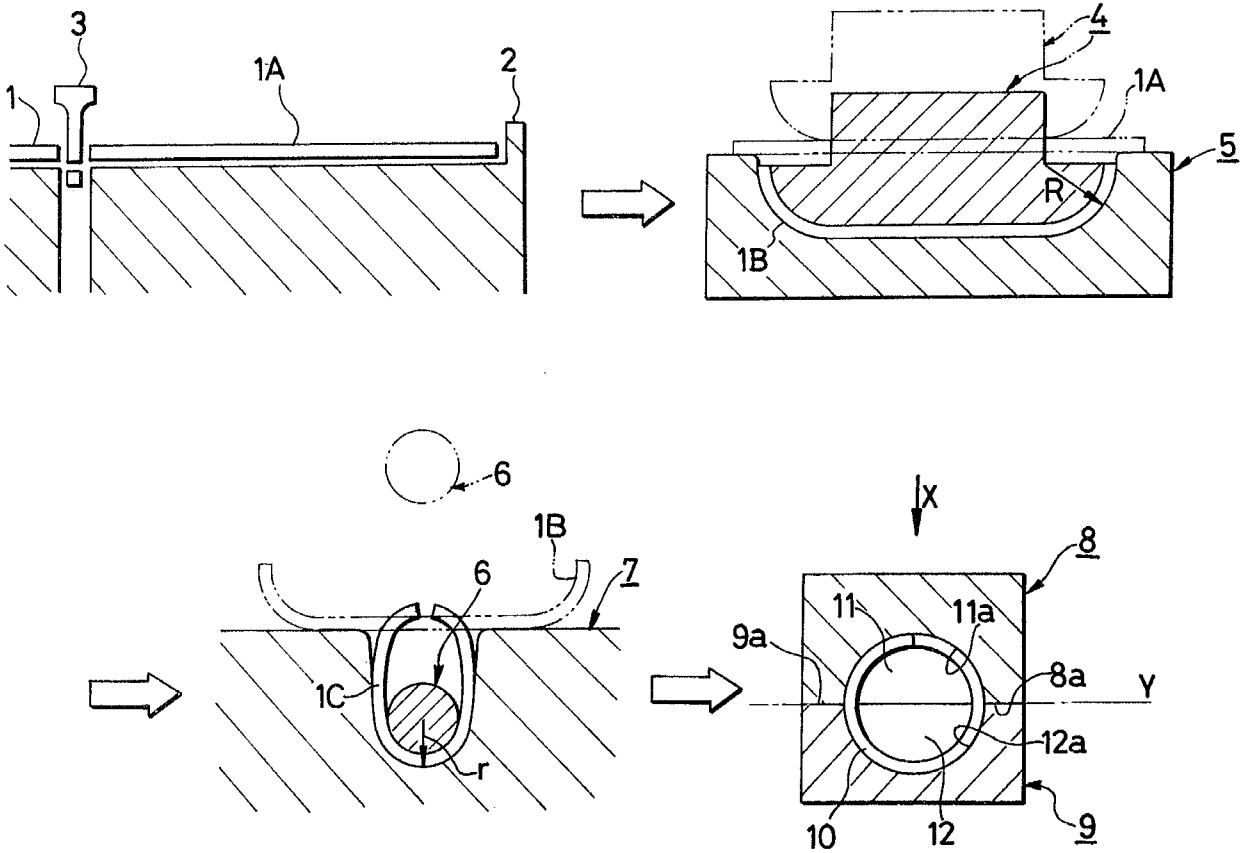
FIG. 1 PRIOR ART
FIG. 1 is a flow diagram illustrating a conventional manufacturing process for a cylindrical member.

Before describing the manufacturing apparatus of the invention, reference is made to the flow diagram of FIG. 1 which illustrates a conventional manufacturing process utilized for manufacturing a cylindrical member such as a spacer, bush, slide bearing or the like. A web material 1 having a given width and thickness is fed into a shearing machine until its free end bears against a stop 2, whereupon a cutting blade 3 is driven downward, cutting the web material 1 to a given length. The strip material 1A cut to the given length is then disposed in place between a pair of dies 4, 5 associated with a press and which are arranged in vertical alignment. When the strip material is pressed by the dies 4, 5, its opposite ends are bent to a given shape. The bent material 1B has a planar bottom suface, and its opposite ends are formed into arcuate surfaces having a radius R which is greater than the radius of a cylindrical member to be manufactured.

The material 1B is then disposed in another press including dies 6, 7 which form it into a substantially U-shaped material 1C having a semi-circular region of a radius r which is less than the radius of the cylindrical member to be manufactured and which corresponds to the central bottom region of the material 1B. Subsequently, the material 1C is placed between a further pair of dies 8, 9, and as the upper die 8 is moved down, it is formed into a cylindrical member 10 of a given configuration and size. In the prior art practice, the dies 8, 9 are formed with semi-circular recesses 11, 12 of an identical configuration in their opposing surfaces, whereby the material 1C is bent along arcuate bearing surfaces 11*a*, 12*a* of the recesses as it is formed into the cylindrical member 10.

Figure 2:
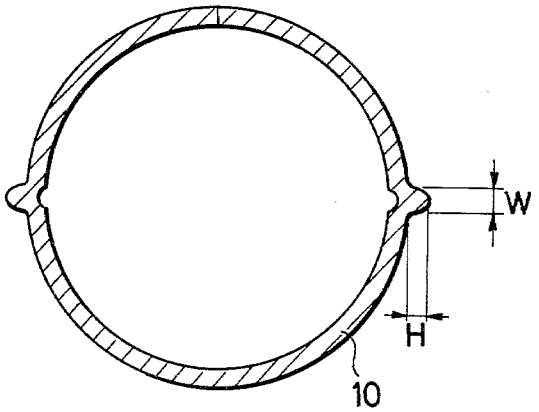
FIG. 2 PRIOR ART
FIG. 2 is a front view of a cylindrical member manufactured with an arrangement illustrated in FIG. 1.

However, with the conventional arrangement which utilized the dies 8, 9, it is necessary that the recesses 11, 12 be of an identical semi-cylindrical configuration, or in other words, the abutting surfaces 8*a*, 9*a* of the both dies 8, 9 lie in a plane Y which includes the axis O of the cylindrical member 10 and which is perpendicular to the direction of movement X of the upper die 8. This resulted in a bulge or a flash to be formed on the outer peripheral surface of the cylindrical member 10 in the region of abutment between the both dies 8, 9, as shown in exaggerated form in FIG. 2. The bulge or flash has a width W and a height H on the order of several tens of micrometers, normally 40 to 50 micrometers. While the reason herefor is not clearly understood, it is believed that the process of bending the U-shaped material 1C along the arcuate bearing surfaces 11*a*, 12*a* takes place by initially forming upper and lower portions of the elongate strip material 1C which bear against the arcuate bearing surfaces 11*a*, 12*a*, followed by a movement of the formed portions of the material 1C toward the abutting surfaces of the both dies 8, 9 as the latter move closer to each other, thereby reducing the clearance between the abutting surfaces at the opposite ends of the U-shaped material 1C until they move into abutment against each other to produce increased stresses in the material to complete the process of forming the strip material 1C in their regions adjacent to the abutting surfaces 8*a*, 9*a* concurrently with the engagement between the dies 8, 9. It is to be noted that the described arrangement is constructed in a manner such that portions of the strip material which are located adjacent to the abutting surfaces of the dies are the last to be formed so that during the final forming step, these portions are subjected to stresses of an increased magnitude, whereby they are forced into very small clearances formed between the both dies 8, 9 before the latter completely engage with each other. As a consequence, a bulge or flash is formed on the outer periphery of the cylindrical member 10 as mentioned above. Therefore, where it is required to manufacture a cylindrical member having a high degree of circularity, the cylindrical member 10 must be subsequently finished by grinding or polishing step, causing an increased cost.

In consideration of the above disadvantage, the present invention prevents a bulge or a flash from being formed on the outer periphery of a cylindrical member, by disposing the abutting surfaces of both dies at a position which is offset from the plane Y.

Figure 3:
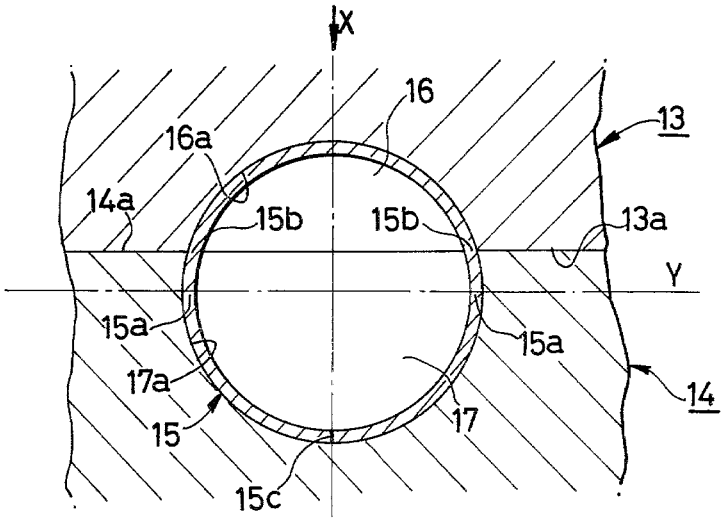
FIG. 3 is a cross section showing one embodiment of the invention.

Referring to FIG. 3, there is shown an embodiment of the invention. A pair of dies 13, 14, which correspond to the conventional dies 8, 9, are formed with recesses 16, 17 in their opposing surfaces having arcuate bearing surfaces 16*a*, 17*a* which coincide with the outer periphery of a cylindrical member 15 to be manufactured when both dies are brought into abutment against each other. In contradistinction to the prior art, the arcuate bearing surfaces 16*a*, 17*a* have different circumferential lengths. Specifically, the arcuate bearing surface 17*a* of the lower die 14 has a greater circumferential length than the conventional semi-circular bearing surface 12*a*, further extending upward, with each extension having a magnitude which exceeds one-half the width W of the bulge. In a corresponding manner, the arcuate bearing surface 16*a* of the upper die 13 has a reduced circumferential length by an amount which corresponds to the length of the extension of the arcuate bearing surface 17*a*. As a consequence, the abutting surfaces 13*a*, 14*a* of the both dies 13, 14 are situated in a plane which is parallel to, but which is offset upward from the plane Y.

In use, when an arrangement utilizing the dies 13, 14 thus constructed is used to form the U-shaped material 1C into a cylindrical member 15, it will be appreciated that no bulge or flash is formed on the cylindrical member 15 inasmuch as there is no gap or clearance or any cavity in a region of the arcuate bearing surface 17*a* which corresponds to the last formed portion 15*a* of material 1C, assuming that the same explanation applies as mentioned previously for the formation of the bulge. Portions 15*b* of the cylindrical member to be manufactured which are located in the vicinity of abutting surfaces 13*a*, 14*a* of the both dies 13, 14 are prevented from expanding outwardly as the clearance between the abutting surfaces 15*c* of the material 1C diminishes from the initial to the middle phase of the movement of the dies 13, 14 toward each other. Later, when dies 13, 14 bear against each other, an outward expansion or bulging of the portions 15*b* is again prevented since the last formed portions 15*a* of the material 1C are caused to be bent along the arcuate bearing surface 17*a*. Consequently, when the apparatus of the invention is used to form a cylindrical member, a cylindrical member 15 having an increased level of circularity as compared with the products of the prior art is obtained, eliminating the need for a subsequent grinding or a polishing step.

Figure 4:
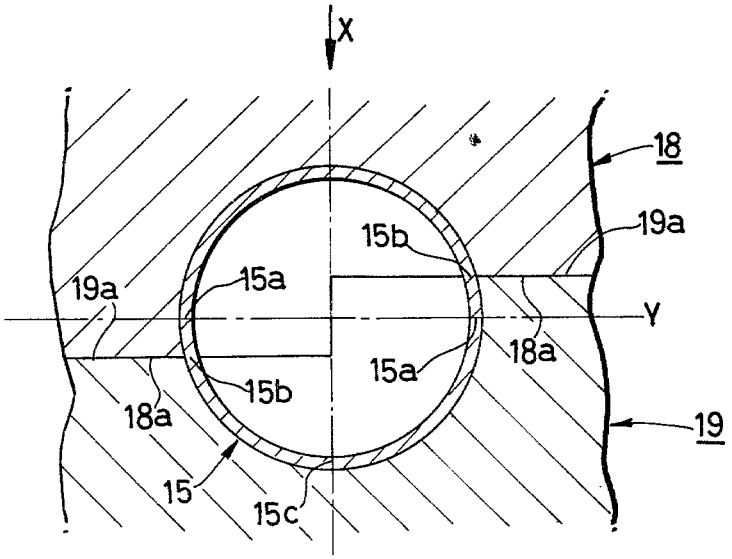
FIG. 4 is a cross section illustrating another embodiment of the invention.

FIG. 4 illustrates another embodiment of the invention including a pair of dies 18, 19 having abutting surfaces 18*a*, 19*a* which are staggered relative to each other. In the present embodiment, the staggered abutting surfaces 18*a*, 19*a* lie on planes which are offset from the plane Y on the opposite sides thereof while maintaining a parallel relationship therewith. It should be understood that the location of these abutting surfaces 18*a*, 19*a* are chosen to avoid the formation of a bulge such as shown at 15*a*. When the abutting surfaces 18*a*, 19*a* are displaced from the plane Y by an equal distance and are joined together by a surface which includes the axis and which extends in a direction parallel to the direction of movement of the dies, the both dies 18, 19 may have an identical configuration.

It should be understood that the formation of a bulge or a flash on the cylindrical member may be prevented by disposing only the portion of the abutting surfaces of the dies which is nearer the arcuate bearing surfaces at a position offset from the plane Y.

While the invention has been described in terms of specific embodiments thereof, it should be understood that other changes and modifications will readily occur to those skilled in the art without departing from the scope and the spirit of the invention as defined by the appended claims.

What is claimed is:

1. A sheet-shaping die structure for manufacturing a cylindrical article by bending a sheet, comprising: a pair of dies having opposed parallel faces, said dies being adapted to be supported for reciprocal relative movement in a first direction between a first position in which said faces are spaced from each other and a second position in which said faces abut against each other, said dies having opposed, complementary, concave, partially cylindrical recesses in said faces thereof, said recesses mating with each other when said dies are in said second position to define a cylindrical cavity of precise cylindrical shape so that a sheet disposed within said recesses is bent into a precise cylindrical shape as said dies are moved from said first position to said second position, said faces having portions extending outwardly from the longitudinal edges of said recesses, each said portion forming a sharp corner with the adjacent edge of its associated recess, said portions of said faces being offset from a first plane which includes the axis of said cylindrical cavity and which first plane is perpendicular to said first direction of relative reciprocal movement of said dies, said portions of said faces being offset from said first plane by a sufficient distance that the portions of said sheet that are bent last as said dies are moved from said first position to said second position contact diametrically opposite unbroken wall portions of said cavity which are vertically offset from said sharp corners, such that said sheet is bent into said cylindrical article without formation of outwardly projecting bulges on said cylindrical article at positions corresponding to said sharp corners.

2. A sheet-shaping die structure as claimed in claim 1 in which said faces are planar so that said portions of each face are flat and coplanar.

3. A sheet-shaping die structure for manufacturing a cylindrical article by bending a sheet, comprising: a pair of dies having opposed parallel faces, said dies being adapted to be supported for reciprocal relative movement in a first direction between a first position in which said faces are spaced from each other and a second position in which said faces abut against each other, said dies having opposed, complementary, concave, partially cylindrical recesses in said faces thereof, said recesses mating with each other when said dies are in said second position to define a cylindrical cavity of precise cylindrical shape so that a sheet disposed within said recesses is bent into a precise cylindrical shape as said dies are moved from said first position to said second position, said faces having portions extending outwardly from the longitudinal edges of said recesses, each said portion forming a sharp corner with the adjacent edge of its associated recess, said portions of said faces being offset from a first plane which includes the axis of said cylindrical cavity and which first plane is perpendicular to said first direction of relative reciprocal movement of said dies, said portions of said faces of said dies on one side of said cavity being planar and lying in a common second plane when said dies are in said second position, said portions of said faces of said dies on the opposite side of said cavity being planar and lying in a common third plane when said dies are in said second position, said second and third planes being located on opposite sides of said first plane, said second and third planes being joined by a fourth plane which passes through the longitudinal axis of said cylindrical cavity and is parallel to said first direction of relative reciprocal movement of said dies.

4. A sheet-shaping die structure as claimed in claim 3 in which said second and third planes are spaced equal distances from said first plane.

5. A sheet-shaping die structure for manufacturing a cylindrical article by bending a sheet, comprising: a pair of dies having opposed parallel faces, said dies being adapted to be supported for reciprocal relative movement in a first direction between a first position in which said faces are spaced from each other and a second position in which said faces abut against each other, said dies having opposed, complementary, concave, partially cylindrical recesses in said faces thereof, said recesses mating with each other when said dies are in said second position to define a cylindrical cavity of precise cylindrical shape so that a sheet disposed within said recesses is bent into a precise cylindrical shape as said dies are moved from said first position to said second position, said faces having portions extending outwardly from the longitudinal edges of said recesses, each said portion forming a sharp corner with the adjacent edge of its associated recess, said portions of said faces being offset from a first plane which includes the axis of said cylindrical cavity and which first plane is perpendicular to said first direction of relative reciprocal movement of said dies, the two pairs of corners respectively located at the opposite sides of said cavity when said faces are in said second position each including a first corner defining an obtuse included angle between its face and a line tangent to said cavity at the point at which said pair of corners meet and a second corner defining an acute included angle between its face and said line.

* * * * *